US006138768A

United States Patent [19]

Fujiki

[11] Patent Number: 6,138,768

[45] Date of Patent: Oct. 31, 2000

[54] GAS TYPE FIRE EXTINGUISHER

[75] Inventor: Masaru Fujiki, 2-32-11, Todoriki, Setagaya-ku, Tokyo, Japan

[73] Assignees: Masaru Fujiki; Shichifuku Co., Ltd., both of Tokyo, Japan

[21] Appl. No.: 09/118,584

[22] Filed: Jul. 17, 1998

[30] Foreign Application Priority Data

Apr. 3, 1998 [JP] Japan ..... 10-107123

[51] Int. Cl.[7] ..... A62C 11/00

[52] U.S. Cl. ..... 169/30; 169/71; 222/5

[58] Field of Search ..... 169/5, 11, 30, 169/71; 222/5

[56] References Cited

U.S. PATENT DOCUMENTS 3,255,824 6/1966 Rodgers ..... 222/5
3,667,549 6/1972 Sachs et al. ..... 167/71
4,454,963 6/1984 Fegley ..... 222/5
4,620,598 11/1986 Reeder ..... 222/5
5,555,940 9/1996 Fujiki ..... 169/60
5,615,743 4/1997 Matsumoto et al. ..... 222/5

*Primary Examiner*—Kevin Shaver
*Assistant Examiner*—David Deal
*Attorney, Agent, or Firm*—Koda & Androlia

[57] ABSTRACT

A fire extinguisher including a gas cylinder filled with an extinguishing gas and installed in a cylindrical main casing that has a nozzle head at one end and a spring-loaded bottom cover at another end. The gas cylinder is retained in the main casing by way of a locking pin that extends radially and engages an actuation hole of the main casing; and when the locking pin is manually disengaged from the actuation hole, the gas cylinder is rapidly moved by an expanding spring of the bottom cover in the direction of the axis of the main casing, so that the sealing plate of the gas cylinder is ruptured by a firing pin of the nozzle head, allowing the gas to jet out of the gas cylinder so as to put out a fire. The locking pin can be automatically disengaged from the actuation hole by the use of a temperature sensor.

6 Claims, 3 Drawing Sheets

GAS TYPE FIRE EXTINGUISHER

BACKGROUND OF THE INVENTION

1. Field of the Invention

The present invention relates to a fire extinguisher and more particularly to a gas type fire extinguisher that is operated either manually or automatically.

2. Prior Art

In conventional manually operated fire extinguishers in which the high-pressure extinguishing gas accommodated inside a gas cylinder is sprayed out by manual operation, the bottom of the gas cylinder is strongly struck, or a tubular casing that contains the gas cylinder is rotated with the head section of the fire extinguisher gripped by hand, thus causing a firing pin to rupture the sealing plate of the gas cylinder so that the extinguishing gas is sprayed out of the gas cylinder in order to put out a fire.

In conventional automatic fire extinguishers that automatically spray high-pressure gas from a gas cylinder, when the temperature sensor mounted to the tubular casing that contains the gas cylinder senses the high temperature of the fire, a firing pin automatically drops and ruptures the sealing plate of the gas cylinder that is positioned beneath the firing pin, thus causing the extinguishing gas to jet out of the gas cylinder.

The conventional gas type fire extinguishers described above in which the extinguishing gas is sprayed out manually has several problems. Among them, the operation of the fire extinguisher is complicated, and the structure of the fire extinguisher is also complex.

In conventional automatic fire extinguishers, the structure is complex, and as a result, manufacturing costs tend to be high.

SUMMARY OF THE INVENTION

Accordingly, it is a primary object of the present invention to provide a fire extinguisher that is simple in structure, easy to assemble and low in manufacturing costs.

It is another object of the present invention to provide a manually operated fire extinguisher in which the sealing plate of a gas cylinder that contains high-pressure extinguishing gas is ruptured by merely using finger(s) to push an operating lever into a hollow main casing so as to release a locking pin, thus rapidly moving the gas cylinder toward a firing pin so that the firing pin ruptures the sealing plate of the gas cylinder, letting the high-pressure extinguishing gas jet out to the fire.

It is still another object of the present invention to provide an automatic fire extinguisher in which when the surrounding temperature reaches a predetermined high level, a temperature sensor operates so as to automatically push an operating lever into a hollow main casing so as to release a locking pin, thus rapidly moving the gas cylinder that contains high-pressure extinguishing gas toward a firing pin so that the filing pin ruptures the sealing plate of the gas cylinder, allowing the high-pressure gas in the gas cylinder to be sprayed out to the fire.

The above objects of the present invention are accomplished by a unique structure for a gas type fire extinguisher of a manual type which comprises:

(a) a hollow main casing which has a top opening surrounded by a flange, an actuation hole formed near the flange, and a bottom opening;

(b) a bottom cover having an opening at its upper end and a reception space inside, the bottom cover being provided with a push-out member installed inside the reception space and pushed by an elastic member;

(c) a nozzle head having an anchoring part that engages the flange of the hollow main casing, a spray hole formed in the central portion of the nozzle head, and an insertion hole into which a firing pin is attached;

(d) a guide piece slidably installed in the hollow main casing, the guide piece having a longitudinal insertion hole into which the head section (equipped with a sealing plate) of a gas cylinder filled with a fire-extinguishing gas is inserted, a lateral insertion hole in which an elastic member is inserted, and a lateral through-hole with a locking pin installed therein, the locking pin having a flange which is constantly pushed by the elastic member, and (e) an operating lever provided on the exterior surface of the hollow main casing so as to push in the locking pin which springs out of the actuation hole of the main casing; and wherein the assemblage is made so that (i) the nozzle head is inserted into the main casing and attached to the top opening thereof, (ii) the elastic member is set inside the lateral insertion hole of the guide piece with the locking pin anchored in the lateral through-hole, (iii) the head section of the gas cylinder is inserted into the longitudinal insertion hole of the guide piece and the guide piece is inserted into the hollow main casing together with the gas cylinder until the locking pin pushed by the elastic member enters into and engages the actuation hole of the hollow main casing, thus making it possible for the operating lever to push against the tip end of the locking pin, and (iv) the bottom cover is attached to cover the bottom opening of the hollow main casing into which the gas cylinder has been inserted.

Furthermore, above objects of the present invention are accomplished by another unique structure for a gas type fire extinguisher of an automatic type which comprises (a) a hollow main casing which has a top opening surrounded by a flange, an actuation hole formed near the flange, and a bottom opening;

(b) a bottom cover having an opening at its upper end and a reception space inside, the bottom cover being provided with a push-out member installed inside the reception space and pushed by an elastic member;

(c) a nozzle head having an anchoring part that engages the flange of the hollow main casing, a spray hole formed in the central portion of the nozzle head, and an insertion hole into which a firing pin is attached;

(d) a guide piece slidably installed in the hollow main casing, the guide piece having a longitudinal insertion hole into which the head section (equipped with a sealing plate) of a gas cylinder filled with a fire-extinguishing gas is inserted, a lateral insertion hole in which an elastic member is inserted, and a lateral through-hole with a locking pin installed therein, the locking pin having a flange which is constantly pushed by the elastic member, and (e) an operating lever provided on the exterior surface of the hollow main casing so as to push in the locking pin which springs out of the actuation hole of the main casing, the operating lever being subjected to a pushing adjustment from the outside by means of a temperature sensor and a guide pin installed inside an automatic mechanical chamber which is mounted on the exterior surface of the hollow main casing; and wherein the assemblage is made so that (i) the nozzle head is inserted into the main casing and attached to the top opening thereof, (ii) the elastic member is set inside the lateral insertion hole of the guide piece with the locking pin being anchored in the lateral through-hole, (iii) the head section of the gas cylinder is inserted into the longitudinal insertion hole of the guide piece and the guide piece is inserted into the hollow main casing together with the gas cylinder until the locking pin pushed by the elastic member enters into and engages the actuation hole of the hollow main casing, thus making it possible for the operating lever to push against the tip end of the locking pin, and (iv) the bottom cover is attached to cover the bottom opening of the hollow main casing into which the gas cylinder has been inserted.

In the above structures, a coil spring is used as the elastic member that is installed in the bottom cover; and another coil spring is used as the elastic member that is installed in the sliding piece to push the locking pin.

With the structures above, when the operating lever is operated by hand manually or operated automatically by the temperature sensor, the operating lever pushes back the locking pin into the hollow main casing; and when the locking pin is thus disengaged from the actuation hole of the main casing, the coil spring installed inside the bottom cover instantaneously pushes the gas cylinder toward the head piece; as a result, the firing pin installed in the head piece ruptures the sealing plate of the gas cylinder, thus allowing the high-pressure gas inside the gas cylinder to be sprayed out to extinguish the fire.

DETAILED DESCRIPTION OF THE INVENTION

Typical embodiments of the present invention will be described with reference to the accompanying drawings.

Figure 1:
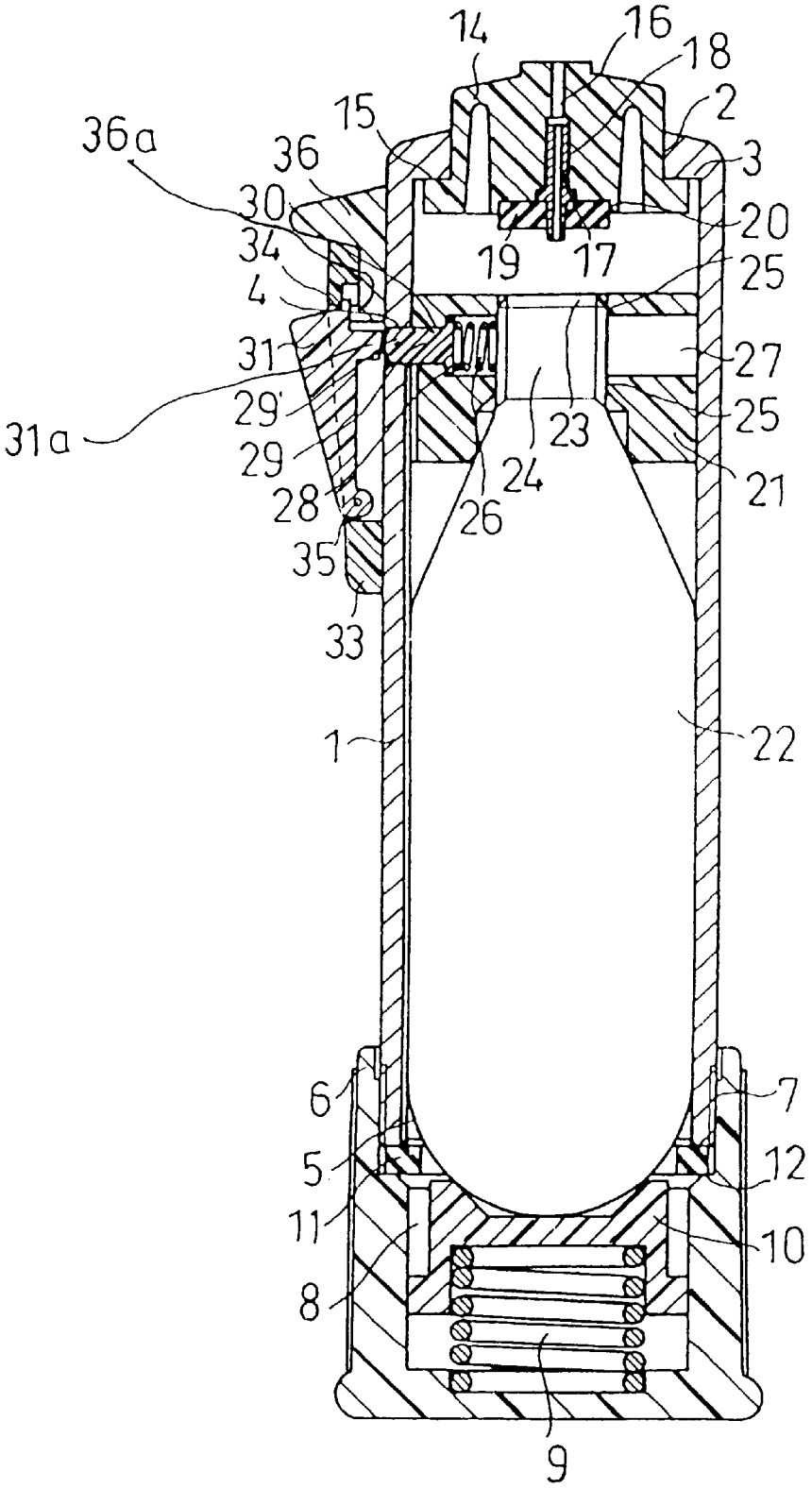
FIG. 1 is a longitudinal-sectional front view of the manually operated gas type fire extinguisher according to the present invention.
Figure 2:
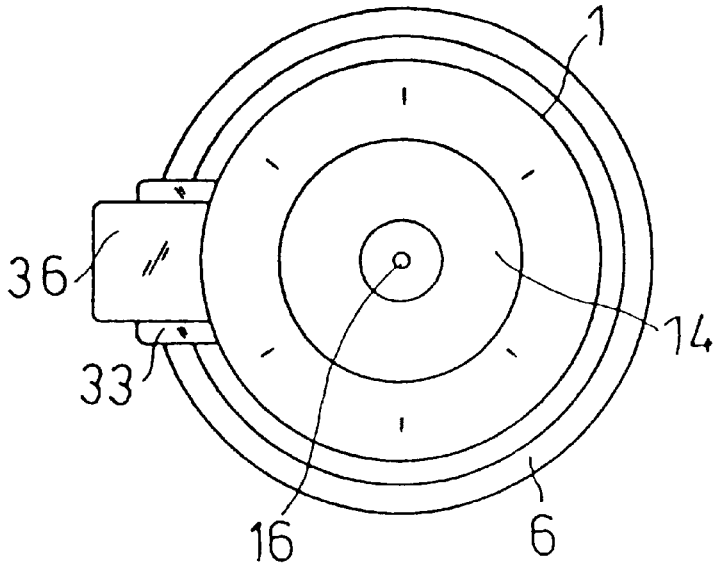
FIG. 2 a top view thereof.

As seen from FIGS. 1 and 2, a cylindrical hollow main casing 1 has a top opening 2 in the upper end (in FIG. 1) thereof. The top opening 2 is surrounded by a flange 3. The main casing 1 is provided with an actuation hole 4 formed slightly below (in FIG. 1) the flange 3 and extends in the radial direction (or in a direction perpendicular to the axis) of the cylindrical main casing 1. In addition, the main casing 1 has a bottom opening 5 in the lower end (in FIG. 1).

The reference numeral 6 is a bottom cover that has a closed bottom. The inside of the bottom cover 6 is empty and is formed with a reception space 8, and the top end (in FIG. 1) thereof has an upper opening 7. A push-out member 10 for pushing a gas cylinder described below is installed inside the reception space 8 of the bottom cover 6 so that it can be pushed by an elastic member or a coil spring 9 towards the upper opening 7. In addition, a ring collar 11 is installed on an inner circumferential step 12 formed near the top portion of the reception space 8 of the bottom cover 6.

A nozzle head 14 is provided with an annular anchoring part 15 so that the nozzle head 14 is attached to the hollow main casing 1 by way of the annular anchoring part 15 engaged with the (inner surface of the flange 3 of the hollow main casing 1. The nozzle head 14 is provided with a spray hole 16 formed in the central portion thereof so that the spray hole 16 extends in the axial direction of the nozzle head 14. An insertion hole 18 slightly larger than the spray hole 16 in diameter is formed continuously to the spray hole 16 so as to be located beneath (in FIG. 1) the spray hole 16. A firing pin 17 is inserted in the insertion hole 18, and a packing 19 is attached to the lower portion of the firing pin 17 so that the packing 19 is fitted in the bottom recess 20 formed in the undersurface of the nozzle head 14.

The reference numeral 21 is a guide piece. The guide piece 21 is somewhat a thick disk with a diameter slightly smaller than the inner diameter of the main casing 1 so that the guide piece 21 is slidable inside the main casing 1 in the direction of the axis of the main casing and retained in the upper portion of the main casing 1. The guide piece 21 is formed with a longitudinal insertion hole 25, a lateral insertion hole 27, and a lateral through-hole 30; and a locking pin 29 that has a flange 28 is inserted in the lateral through-hole 30, and an elastic member or a coil spring 26 is installed in the lateral insertion hole 27. The head section 24 of a gas cylinder 22 that is filled with a high-pressure fire-extinguishing gas such as carbon dioxide is inserted Into the longitudinal insertion hole 25, so that the coil spring 26 is compressed between the head section 24 of the gas cylinder 22 and the flange 28 of the locking pin 29. The head section 24 of the gas cylinder 22 is capped by a sealing plate 23. The coil spring 26 constantly pushes the locking pin 2 outwardly or in the radial direction of the main casing 1; in other words, the flange 28 formed at one end of the locking pin 29 is pushed by the spring 26 so that the tip end 29' of the locking pin 29 is positioned outside the lateral through-hole 30 of the guide piece 21 and located in and engaged with the actuation hole 4 of the main casing 1. Thus, the locking pin 29 positioned in the radial direction of the main casing 1 is long enough to penetrate through the lateral through-hole 30 and enter into the actuation hole 4 of the main casing 1, and the flange 28 of the locking pin 29 is larger in diameter than the inner diameter of the lateral through-hole 30 of the guide piece 21.

An operating lever 31 is installed on the exterior surface of the hollow main casing 1 so that the operating lever 31 can press, via its inward projection 31 a, the tip end 29' of the locking pin 29 which is pushed by the spring 26 into the actuation hole 4 of the main casing 1 via the lateral through-hole 30 of the guide piece 21. The operating lever 31 is installed inside a safety guide 33 provided on the exterior surface of the main casing 1 so that the operating lever 31 is accessible from the outside through a window hole 34 formed in the safety guide 33. The operating lever 31 is pivotable at one end (lower end in FIG. 1) thereof by a pin 35, and another end (upper end in FIG. 1) of the operating lever 31 is engaged with an engagement section 36*a* of a safety knob 36 which is slidably installed on the exterior surface of the main casing 1. The operating lever 31 is thus prevented from pivoting toward the main casing 1; and the safety knob 36 avoids accidentally pushing the locking pin 29.

With the respective members described above, the fire extinguisher is assembled in the following manner:

The nozzle head 14 with the firing pin 18 and packing 19 fitted thereto is first inserted into the main casing 1 from the bottom opening 5. The nozzle head 14 is pushed to the top opening 2 and anchored by engaging with the flange 3 of the hollow main casing 1 with the firing pin 17 pointing at the bottom opening 5.

The locking pin 29 is inserted into the lateral through-hole 30 of the guide piece 21, and the coil spring 26 is installed in the lateral insertion hole 27 of the guide piece 21 so that one end of the coil spring 26 is in touch with the flange 28 of the locking pin 29. Then, the head section 24 of the gas cylinder 22 is inserted into the longitudinal insertion hole 25 of the guide piece 21. The longitudinal insertion hole 25 extends cross-wise with respect to the lateral insertion hole 27; therefore, the coil spring 26 is held between the flange 28 of the locking pin 29 and the head section 24 of the gas cylinder 22. As a result, the locking pin 29 is anchored by its flange 28 in the lateral through-hole 30 by being pressed by the compressed coil spring 26 with the tip end 29' of the locking pin 29 out of the lateral through-hole 30 (this is not shown).

After the gas cylinder 22 is thus attached to the guide piece 21, the guide piece 21 is inserted into the main casing 1 together with the gas cylinder 22. When the guide piece 21 is brought into the main casing 1, the locking pin 29 is pressed inside the lateral through-hole 30 of the guide piece 21 since the tip end 29' of the locking pin 29 is in contact with the inner surface of the main casing 1. Thus, the coil spring 26 is further compressed by the flange 28 and the head section 24.

The guide piece 21 and the gas cylinder 22 are pushed by hand toward the nozzle head 14. When the lateral through-hole 30 of the guide piece 21 is moved to a location positionally corresponding to the actuation hole 4 of the main casing 1, the contact between the tip end 20' of the locking pin 29 and the inner surface of the main casing 1 is released, the locking pin 29 is pushed outwardly by the expanding coil spring 26, and the tip end 29' of the locking pin 29 enters into and engages the actuation hole 4 of the main casing 1. As a result, the operating lever 31 and the locking pin 29 come into contact, and the operating lever 31 is slightly pushed outward by the coil spring 26.

Then, the bottom cover 6 is screw-mounted to the main casing 1 so as to cover the bottom opening 5 of the main casing 1 into which the gas cylinder 22 has been inserted as described above. When the bottom cover 6 is mounted to the main casing 1, the coil spring 9 is compressed by the bottom of the gas cylinder 22 with the push-out member 10 in between.

Assembly of the fire extinguisher is thus completed.

The fire extinguisher thus assembled is manually operated, and the high-pressure extinguishing gas filled in the gas cylinder 22 is sprayed at a fire in the following fashion:

When a fire occurs, the fire extinguisher is first gripped by one hand, aiming at the base of fire. Then, the safety knob 36 is rotated by the other hand, disengaging the operating lever 31 from the safety knob 36. Afterward, overcoming the spring force of the coil spring 26, the operating lever 31 is pressed toward the main casing 1 by the finger(s) of the gripping hand through the window hole 34 of the safety guide 33. When the operating lever 31 is thus pressed, the locking pin 29 which has been pushed by the coil spring 26 is pushed back inwardly so that the tip end 29' of the locking pin 29 is brought so as to be flush with the inner surface of the hollow main casing 1. As a result, the locking pin 29 is disengaged from the actuation hole 4 of the main casing 1. When the locking pin 29 is thus disengaged, the gas cylinder 22 and guide piece 21 are swiftly moved in the direction of the axis of the main casing 1 toward the nozzle head 14 by the strong expansion force of the coil spring 9 with the push-out element 10 in between.

Due to the strong expansion force of the coil spring 9, the sealing plate 23 of the gas cylinder 22 is pushed toward the nozzle head 14 and strikes the firing pin 17 which is fixed in the insertion hole 18 of the nozzle head 14. As a result, the firing pin 17 ruptures the sealing plate 23, and the high-pressure extinguishing gas accommodated in the gas cylinder 22 rushes out of the gas cylinder 22 and is sprayed out of the nozzle head 14 through the spray hole 16, thus extinguishing the fire.

After the high-pressure extinguishing gas in the gas cylinder 22 is used up, the bottom cover 6 is removed from the main casing 1, and the gas cylinder 22 and guide piece 21 are taken out of the main casing 1. It is desirable to turn the gas cylinder 22 when it is taken out of the main casing 1 so as to avoid the locking pin 29 of the guide piece 21 from re-engaging the actuation hole 4 of the main casing 1

A new gas cylinder 22 is attached to the guide piece 21, the guide piece 21 and the new gas cylinder 22 are inserted into the hollow main casing 1, and then the bottom cover 6 is attached to the hollow main casing 1. The fire extinguisher can thus be easily reassembled and ready for the next use.

As seen from the above, according to the present invention, the locking pin is shifted toward the inside of the main casing merely by sliding the safety knob and then pushing the operating lever with finger(s); and when the locking pin reaches a prescribed position, the gas cylinder is instantaneously pushed toward the nozzle head, so that the firing pin installed in the nozzle head ruptures the sealing plate of the gas cylinder, allowing the extinguishing gas inside the gas cylinder to be sprayed through the spray hole of the nozzle head, thus extinguishing the fire.

A second embodiment of the present invention will be described below with reference to FIGS. 3 and 4.

The fire extinguisher of the second invention is designed so as to be automatically actuated when the surrounding temperature reaches a prescribed temperature by way of the use of a temperature sensor that automatically disengages the locking pin from the main casing so that the sealing plate of the gas cylinder is ruptured by the firing pin, causing the accommodated extinguishing gas to be sprayed out. Since the basic structure of the fire extinguisher of the second embodiment is substantially the same as that of the first embodiment, the second embodiment will be described briefly except for the featuring structure. Elements which are common to both constructions are indicated by the same reference numerals.

Figure 4:
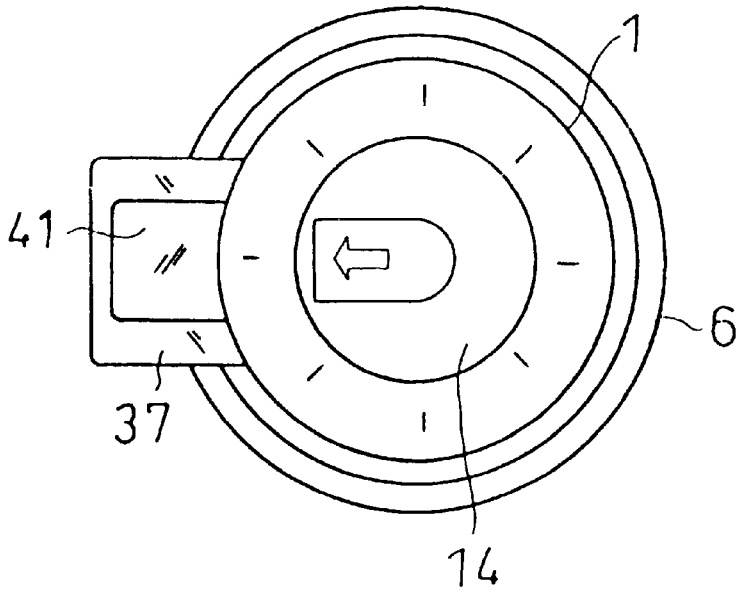
FIG. 4 is a top view thereof
Figure 3:
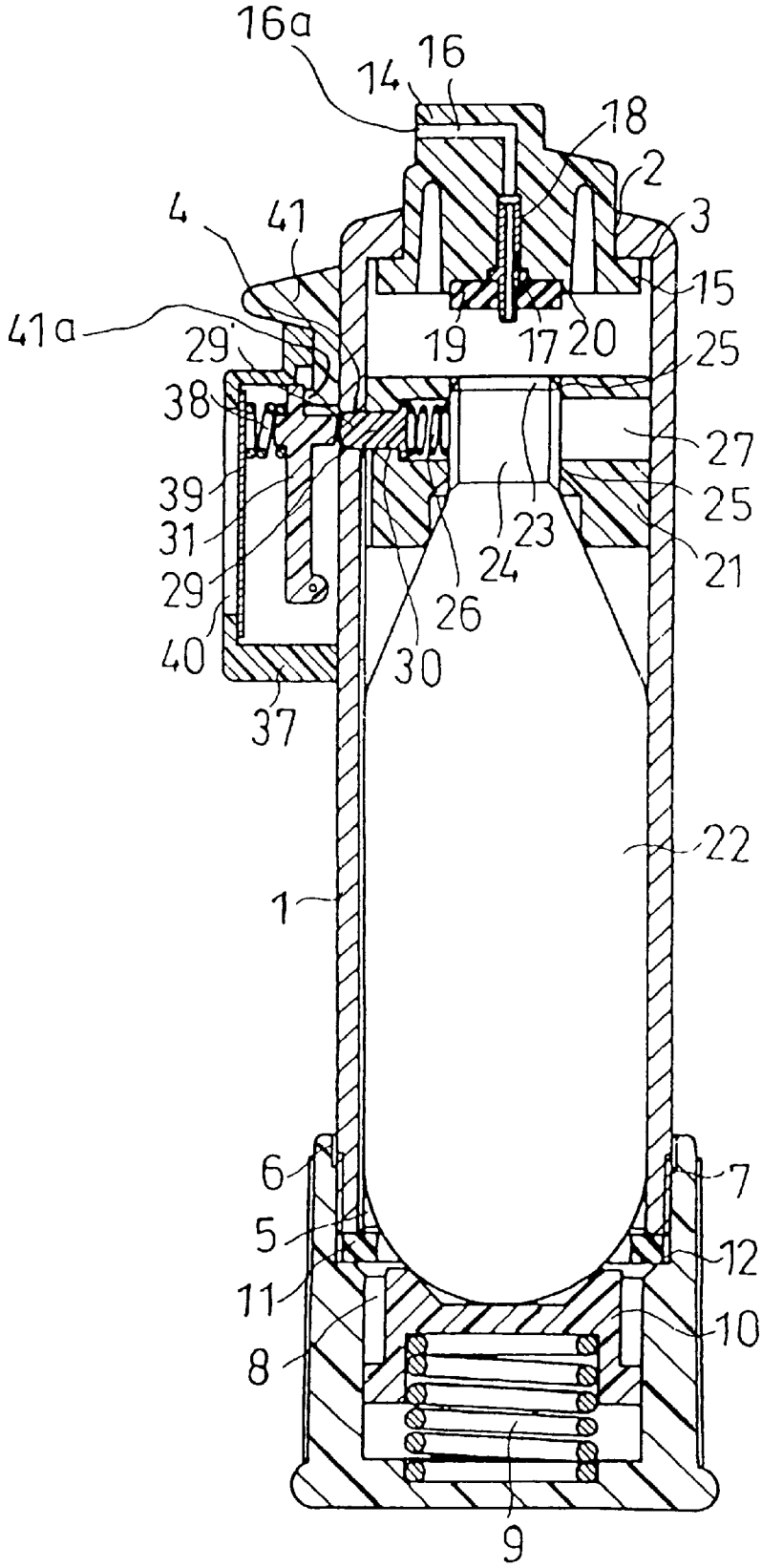
FIG. 3 is a longitudinal-sectional front view of the automatic gas type fire extinguisher according toy present invention.

As seen from FIGS. 3 and 4, the cylindrical hollow main casing 1 has a top opening 2 surrounded by a flange 3. An actuation hole 4 is opened in the main casing so as to be slightly below (in FIG. 1) the flange 3. The actuation hole 4 extends in the radial direction of the cylindrical main casing 1. The main casing 1 further has a bottom opening 5.

The bottom cover 6 has a reception space 8 inside. A gas cylinder push-out member 10 is installed inside the reception space 8 so that the push-out member 10 can be pushed by an elastic member or a coil spring 9. A ring collar 11 is installed on an inner circumferential step 12 formed in the upper portion of the reception space 8 of the bottom cover 6.

The nozzle head 14 has an annular anchoring part 15 that engages the inside surface of the flange 3 of the hollow main casing 1. The nozzle head 14 is thus attached to the opening 2 of the main casing 1 via the anchoring part 15. A spray hole 16 is formed in the nozzle head 14 so as to be in an inverted letter L-shape; thus, the spray hole 16 extends in the axial direction of the nozzle head 14 and opens in the side surface of the nozzle head 14 as shown in FIG. 3. The insertion hole 18 which is slightly larger than the spray hole 16 in diameter is formed continuously to the spray hole 16, being located beneath (in FIG. 1) the spray hole 16. The firing pin 17 is inserted in the insertion hole 18; and the packing 19 is attached to the lower portion of the firing pin 17 so as to be fitted in the bottom recess 20 formed in the undersurface of the nozzle head 14.

The guide piece 21 is substantially a disk having a certain thickness with a diameter slightly smaller than the inner diameter of the main casing 1 so that guide piece 21 is slidable inside the main casing 1 in the direction of the axis of the main casing 1. The guide piece 21 has a longitudinal insertion hole 25, a lateral insertion hole 27 and a lateral through-hole 30; and a locking pin 29 is installed in the lateral through-hole 30. In the longitudinal insertion hole 25, the head section 24 of a gas cylinder 22 filled with a high-pressure fire-extinguishing gas is to be inserted, the head section 24 being covered by a sealing 23. An elastic member or a coil spring 26 is installed inside the lateral insertion hole 27. The coil spring 26 constantly pushes the locking pin 29 outwardly; in other words, the flange 28 of the locking pin 29 is constantly pushed by the spring 26 which is located between the head section 24 of the gas cylinder 22 and the flange 28 of the locking pin 29 so that the tip end 29' of the locking pin 29 stays out of the lateral through-hole 30 of the guide piece 21.

The operating lever 31 is installed on the exterior surface of the main casing 1 so that the operating lever 31 can press, via its inward projection 31*a*, the tip end 29' of the locking pin 29 which is pushed by the spring 26 and engaged with the actuation hole 4 of the main casing 1. The operating lever 31 is subjected to a pushing adjustment from the outside by a guide spring 38 and a temperature sensor 39 so that the operating lever 31 and the locking pin 29 are balanced and the locking pin 29 stays inside the actuation hole 4 of the main casing 1. The guide spring 38 and temperature sensor 39 are provided inside an automatic mechanical chamber 37 which is mounted on the exterior surface of the hollow main casing 11 so that the guide spring 38 is located between the operating lever 31 and the temperature sensor 39. The mechanical chamber 37 has a window hole 40, and a safety knob 41 which has an engagement section 41*a* engaged with the upper end (in FIG. 3) of the operating lever 31 is provided on the exterior surface of the main casing 1 so as to be slid or rotated in the circumferential direction. The operating lever 31 is thus prevented from pivoting toward the main casing 1.

The fire extinguisher of the second embodiment is assembled in the following manner:

The nozzle head 14 is first inserted and attached to the main casing 1. The locking pin 27 is placed in the lateral through-hole 30 of the guide piece 21, and the spring 26 is installed in the lateral insertion hole 27 of the guide piece 21. Afterward, the head section 24 of the gas cylinder 22 is inserted into the longitudinal insertion hole 25 so that the spring 26 is held between the flange 28 of the locking pin 29 and the head section 24 of the gas cylinder 22. The guide piece 21 is then inserted into the main casing 1 together with the gas cylinder 22. The guide piece 21 and the gas cylinder 22 are pushed toward the nozzle head 14 until the tip end 29 of the locking pin 29 is pushed into and engaged with the actuation hole 4 of the hollow main casing 1 by the spring 26. As a result, the operating lever 31 and the locking pin 29 come into contact, and the operating lever 31 is pushed toward the tip end 29' of the locking pin 29 which is pushed out of the actuation hole 4 by the spring 26. The bottom cover 6 is screwed-engaged to the bottom of the main casing 1. When the bottom cover 6 is thus mounted to the main casing 1 and moved towards the nozzle head 14, the spring 9 inside the bottom cover 6 is compressed by the bottom of the gas cylinder 22 with the push-out member 10 in between. Assembly of the fire extinguisher is thus completed.

In use, the fire extinguisher is set upright against the wall of a building with the spray opening 16 facing opposite from the wall. The safety knob 41 is rotated so that the engagement section 41*a* is disengaged from the operating lever 31.

When a fire starts and the temperature around the fire extinguisher rises to a predetermined temperature, the temperature sensor 39 functions and extends. As a result, the guide spring 38 pressed by the sensor 39 pushes the operating lever 31 towards the main casing 1. When the operating lever 31 is thus pushed, the locking pin 29 which has been pushed by the coil spring 26 is moved inwardly so that tip end 29' of the locking pin 29 is brought so as to be flush with the inner surface of the hollow main casing 1. As a result, the locking pin 29 disengages from the actuation hole 4 of the main casing 1, and the coil spring 9 of the bottom cover 6 exerts a strong push to the gas cylinder 22 and guide piece 21 toward the nozzle head 14.

Because of this push by the coil spring 9, the head section 24 of the gas cylinder 22 is strongly hit against the nozzle head 14, and the firing pin 17 installed in the nozzle head 14 ruptures the sealing plate 23 of the gas cylinder 22. As a result, the high-pressure extinguishing gas accommodated in the gas cylinder 22 jets out and is sprayed from the spray opening 16*a* through the spray hole 16 of the nozzle head 14, thus extinguishing the fire.

After the high-pressure extinguishing gas in the gas cylinder 22 is used up, the used gas cylinder is removed from the main casing 1 and replaced with a new gas cylinder for the next use. The fire extinguisher can thus be easily reassembled.

In the fire extinguishers described above, since the spring 26 is used, the tip end 29' of the locking pin 29 is constantly and reliably kept in the actuation hole 4 of the hollow main casing 11.

In addition, since the coil spring 9 is employed, when the locking pin 29 is manually or automatically disengaged from the actuation hole 4 of the main casing 1, the gas cylinder 22 is instantaneously and reliably pushed toward the nozzle head 14 by the spring 9 so that the sealing plate 23 of the gas cylinder 22 is ruptured by the firing pins 17.

As seen from the above, according to the present invention, a fire extinguisher that is simple in structure, easy to assemble and low in manufacturing costs can be obtained.

I claim:

1. A gas type fire extinguisher comprising:

a hollow main casing which has a top opening surrounded by a flange, an actuation hole formed near said flange, and a bottom opening;

a bottom cover having an upper opening and a reception space inside thereof, said reception space being provided therein with a push-out member and a first elastic member which pushes said push-out member toward said upper opening;

a nozzle head provided with an anchoring part that engages said flange of said main casing, said nozzle head being further provided with a spray hole in a central portion thereof and an insertion hole formed continuously to said spray hole with a firing pin inserted in said insertion hole;

a guide means slidably installed in said main casing, said guide means having a longitudinal insertion hole into which a head section equipped with a sealing plate of a gas cylinder filled with a fire-extinguishing gas is inserted, a lateral insertion hole in which a second elastic member is inserted, and a lateral through-hole with a locking means installed therein, said locking means having a flange constantly pushed by said second elastic member; and an operating lever provided on an exterior surface of said main casing so as to push in said locking means which springs out of said actuation hole of said main casing; and wherein said fire extinguisher is assembled so that said nozzle head is inserted into said main casing and attached to said top opening of said main casing, said second elastic member is set inside said lateral insertion hole of said guide means with said locking means being anchored in said lateral through-hole, said head section of said gas cylinder is inserted into said longitudinal insertion hole of said guide means and said guide means is inserted into said main casing together with said gas cylinder until said locking means pushed by said second elastic member is inserted into and engaged with said actuation hole of said main casing, thus allowing said operating lever to push against a tip end of said locking means, and said bottom cover is attached to said main casing such that said upper opening of said bottom cover covers said bottom opening of said main casing into which said gas cylinder has been inserted and said push-out member is engaged with a bottom of said gas cylinder and said first elastic member is compressed to bias said push-out member and said gas cylinder toward said firing pin.

2. A gas type fire extinguisher according to claim 1, wherein said first elastic member provided in said bottom cover is a coil spring.

3. A gas type fire extinguisher according to claim 1, wherein said second elastic member that pushes said locking means is a coil spring.

4. A fire extinguisher comprising:

a cylindrical main casing provided with an actuation hole extending in a radial direction of said main casing;

a nozzle head disposed at one end of said main casing, said nozzle head being provided with a firing pin therein;

a uas cylinder installed in said main casing so as to be slidable in an axial direction of said main casing, said gas cylinder being filled with fire-extinguishing gas and provided with a sealing plate at one end thereof;

a sliding means installed in said main casing and attached to said gas cylinder;

a locking means provided in said sliding means, a first spring means provided in said sliding means so as to urge said locking means in said radial direction of said main casing, thus engaging said locking means with said actuation hole of said main casing;

a bottom cover removably attached to another end of said main casing, said bottom cover being provided therein with a second elastic means urging said gas cylinder in said axial direction of said main casing towardsaid firing pin; and an operating lever disposed on an exterior surface of said main casing, said operating lever when operated disengaging said locking pin from said actuation hole of said main casing, thus allowing said second spring means to expand to move said gas cylinder toward said firing pin so that said firing pin ruptures said sealing plate of said gas cylinder.

5. A gas type fire extinguisher according to claim 4, wherein said second elastic member provided in said bottom cover is a coil spring.

6. A gas type fire extinguisher according to claim 4, wherein said first spring means that pushes said locking means is a coil spring.

* * * * *